US009553409B2

(12) United States Patent
Deng

(10) Patent No.: US 9,553,409 B2
(45) Date of Patent: Jan. 24, 2017

(54) ELECTRICAL TONGUE CONNECTOR WITH GOOD SHIELDING AND IMPROVED CONTACT PERFORMANCE

(71) Applicant: SHENZHEN LITCKCONN TECHNOLOGY CO., Ltd., Shenzhen, Guangdong (CN)

(72) Inventor: Huilun Deng, Guangdong (CN)

(73) Assignee: SHENZHEN LITCKCONN TECHNOLOGY CO., LTD, Shenzhen, Guangdong (CN)

( * ) Notice: Subject to any disclaimer, the term of this patent is extended or adjusted under 35 U.S.C. 154(b) by 0 days.

(21) Appl. No.: 14/932,450

(22) Filed: Nov. 4, 2015

(65) Prior Publication Data

US 2016/0134058 A1 May 12, 2016

(30) Foreign Application Priority Data

Nov. 7, 2014 (CN) ..... 2014 2 0661448 U

(51) Int. Cl.

| | |
|---|---|
| ***H01R 13/6581*** | (2011.01) |
| ***H01R 13/646*** | (2011.01) |
| ***H01R 24/76*** | (2011.01) |
| ***H01R 13/504*** | (2006.01) |
| ***H01R 13/627*** | (2006.01) |
| ***H01R 24/60*** | (2011.01) |

(52) U.S. Cl.

CPC ..... *H01R 13/6581* (2013.01); *H01R 13/504* (2013.01); *H01R 13/6273* (2013.01); *H01R 13/646* (2013.01); *H01R 24/60* (2013.01); *H01R 24/76* (2013.01)

(58) Field of Classification Search

CPC .... H01R 13/646; H01R 24/76; H01R 13/6581
USPC ..... 439/607.01, 607.4, 607.35, 607.37, 660
See application file for complete search history.

(56) References Cited

U.S. PATENT DOCUMENTS

2015/0194768 A1* 7/2015 Little ..... H01R 13/6594 439/607.37
2015/0244110 A1* 8/2015 Ju ..... H01R 13/6585 439/607.01

* cited by examiner

*Primary Examiner* — Abdullah Riyami
*Assistant Examiner* — Justin Kratt
(74) *Attorney, Agent, or Firm* — Jackson IPG PLLC; Demian K. Jackson

(57) ABSTRACT

A connector plug comprises a shielding shell, an insulating base, a terminal module and two baffles, the insulating base comprises a base and a tongue plate connected to a front end of the base, a front end face of the tongue plate being backwards concavely provided with a slot running through a rear end of the base; the terminal module comprises an upper terminal module, a lower terminal module and a hook plate sandwiched between the upper terminal module and the lower terminal module; the terminal module is embedded into the slot of the insulating base; and the two baffles are disposed on upper and lower surfaces of the tongue plate, respectively, the shielding shell encloses the tongue plate and the two baffles, and the two baffles are connected to the shielding shell, respectively.

6 Claims, 9 Drawing Sheets

ELECTRICAL TONGUE CONNECTOR WITH GOOD SHIELDING AND IMPROVED CONTACT PERFORMANCE

FIELD OF THE INVENTION

The present invention relates to the technical field of electric connectors, in particular to a connector plug.

BACKGROUND OF THE INVENTION

At present, connectors have been widely applied in electronic products for data transmission, charge, video transmission and other functions. With the development demand and trend of light and thin electronic products (for example, various ultra-thin tablets, mobile phones, two-in-one boxes, other special mobile devices, etc.), connectors are becoming lighter and thinner in order to conform to the corresponding size of electronic products. As the size of connectors becomes smaller, the size of corresponding structural components is limited and the distance between an upper row of contact terminals and a lower row of contact terminals becomes smaller too. Accordingly, new problems appear: interference of signal is caused between the upper row of contact terminals and the lower row of contact terminals, and it is likely to result in unstable data transmission as the conventional shielding structure design is unable to provide for good shielding effect; and, the structure for assembling the upper row of contact terminals and the lower row of contact terminals within an insulating base is also unstable or complicated in procedure.

Therefore, it is urgent to propose a new technical solution to solve the above problems.

SUMMARY OF THE INVENTION

Accordingly, in view of the deficiencies of the prior art, a main objective of the present invention is to provide a connector plug which is easy to manufacture and quick and firm to assemble, improves the contact performance of terminals, has good shielding effect and thus ensures stable signal transmission.

To achieve the above objective, the present invention employs the following technical solutions.

A connector plug is provided, including a shielding shell, an insulating base, a terminal module and two baffles, wherein the insulating base includes a base and a tongue plate connected to a front end of the base, a front end face of the tongue plate being backwards concavely provided with a slot running through a rear end of the base;

the terminal module includes an upper terminal module, a lower terminal module and a hook plate sandwiched between the upper terminal module and the lower terminal module; the upper terminal module includes an upper terminal port and an upper terminal group embedded into the upper terminal port; the lower terminal module includes a lower terminal port and a lower terminal group embedded into the lower terminal port; the hook plate includes two hooks and a spacer connected between the two hooks, the spacer isolating the upper terminal group from the lower terminal group; the upper terminal port, the lower terminal port and the spacer are correspondingly provided with positioning holes which are communicated to each other, and the upper terminal module, and the lower terminal module and the hook plate form an integral terminal module structure by secondary embedment molding through the positioning holes;

the terminal module is embedded into the slot of the insulating base, with the upper and lower terminal groups exposed from the upper and lower inner wall faces of the slot; a plurality of through holes running through the slot are formed on the upper and lower surfaces of the tongue plate, isolating arms being formed between adjacent through holes, the through holes being disposed to correspond to the terminals one by one; and the two baffles are disposed on upper and lower surfaces of the tongue plate, respectively, the shielding shell encloses the tongue plate and the two baffles, and the two baffles are connected to the shielding shell, respectively.

As a preferred solution, a first limiting bulge is downwards convexly provided on one side of a bottom end face of the upper terminal port, and a second limiting bulge is upwards convexly provided on another side of a top end face of the lower terminal port; when the upper and lower terminal modules are superposed, the first limiting bulge touches against the top end face of the lower terminal port, the second limiting bulge touches against the bottom end face of the upper terminal port, and an accommodating chamber is sandwiched between the upper and lower terminal ports; notches corresponding to the first and second limiting bulges are formed between the spacer and the hooks, respectively; and the spacer is located within the accommodating chamber, and the first and second limiting bulges pass through the corresponding notches, respectively.

As a preferred solution, positioning blocks are convexly provided on the top end face of the upper terminal port and the bottom end face of the lower terminal port, respectively; and correspondingly, positioning grooves running through the slot are formed on the upper and lower surfaces of the tongue plate, respectively; and, when the terminal module is embedded into the slot of the insulating base, the positioning blocks are inserted into the corresponding positioning grooves, respectively.

As a preferred solution, each of the baffles includes a base plate portion for covering each connecting portion of the corresponding upper and lower terminal groups, extended arms separately integrally extending forwards from two sides of a front edge of the base plate portion and a connecting arm connected between the two extended arms; the base plate portion, the two extended arms and the connecting arm are enclosed to form an exposing cavity which is disposed to correspond to each contact portion of the upper and lower terminal groups; and, a first contact spring piece for reinforcing a plug-in/out force and a second contact spring piece for maintaining elastic contact connection to the shielding shell in an up-down direction are integrated at the front edge of the connecting arm, the direction of the contact elastic force of the first contact spring piece being opposite to that of the second contact spring piece.

As a preferred solution, a contact bulge is convexly provided on the base plate portion of each of the baffles, and the contact bulge is in close contact against the inner wall face of the shielding shell in the up-down direction.

As a preferred solution, the shielding shell is of an integral chamber structure having a front opening and a rear opening, a cross section of the shielding shell in a direction vertical to an insertion direction being of a non-splicing closed-loop structure; a clasp is provided at a rear end of the shielding shell, the clasp including an embedding portion integrally extending backwards from the rear end of the shielding shell and a clasping portion integrally disposed at the rear end of the embedding portion; correspondingly, an embedding groove is formed on the insulating base, and when the shielding shell is assembled onto the insulating base, the clasp is embedded into the embedding groove and the clasping portion is reversely clasped onto the insulating base.

Compared with the prior art, the present invention has obvious advantages and beneficial effects. Specifically, from the above technical solutions, it can be seen that:

first, by embedding the upper and lower terminal groups into the respective terminal ports by primary embedment molding to form independent upper and lower terminal modules, and then superposing the upper terminal module, the hook plate and the lower terminal module in turn and forming an integral terminal module structure by secondary embedment molding through positioning holes, this connector plug is easy to manufacture and the positioning of the upper and lower terminal groups is more accurate and firm; and it is advantageous for the improvement of the contact performance of terminals and the stable signal transmission is ensured;

second, positioning blocks are convexly provided on the top end face of the upper terminal port and the bottom end face of the lower terminal port, respectively, and positioning grooves running through the slot are formed on the upper and lower surfaces of the tongue plate, respectively, so that the positioning blocks are inserted into the corresponding positioning grooves respectively when the integral terminal module structure is embedded into the slot of the insulating base from back to front, thereby realizing firm assembling and positioning, and preventing the terminal module from loosening or shifting within the insulating base;

third, by forming an exposing cavity on each of the baffles, signal transmission is protected against the collision or interference between the upper and lower terminal groups and the baffles; by convexly providing contact bulges on the baffles, the contact bulges are in close contact against with the inner wall face of the shielding shell in the up-down direction, so that a good contact break-over between the baffles and the shielding shell and better shielding effect are realized and the stable signal transmission is further ensured; and fourth, in the present invention, the shielding shell is of an integral chamber structure having a front opening and a rear opening, which significantly differs from the traditional splicing enclosure design, with a cross section of the shielding shell in a direction vertical to an insertion direction being of a non-splicing closed-loop structure; as a clasp is provided at a rear end of the shielding shell, the shielding shell is sheathed outside the tongue plate from the rear opening of the shielding shell during assembling, the clasp is embedded into the embedding groove and the clasping portion is reversely clasped onto the insulating base, so that the shielding shell and the insulating base are assembled firmly prevent the shielding shell from loosening and it is advantageous for the shielding effect.

To explain the structural features and functions of the present invention more clearly, the present invention will be described as below in details with reference to the accompanying drawings by specific embodiments.

DETAILED DESCRIPTION OF THE PREFERRED EMBODIMENTS

Figure 1:
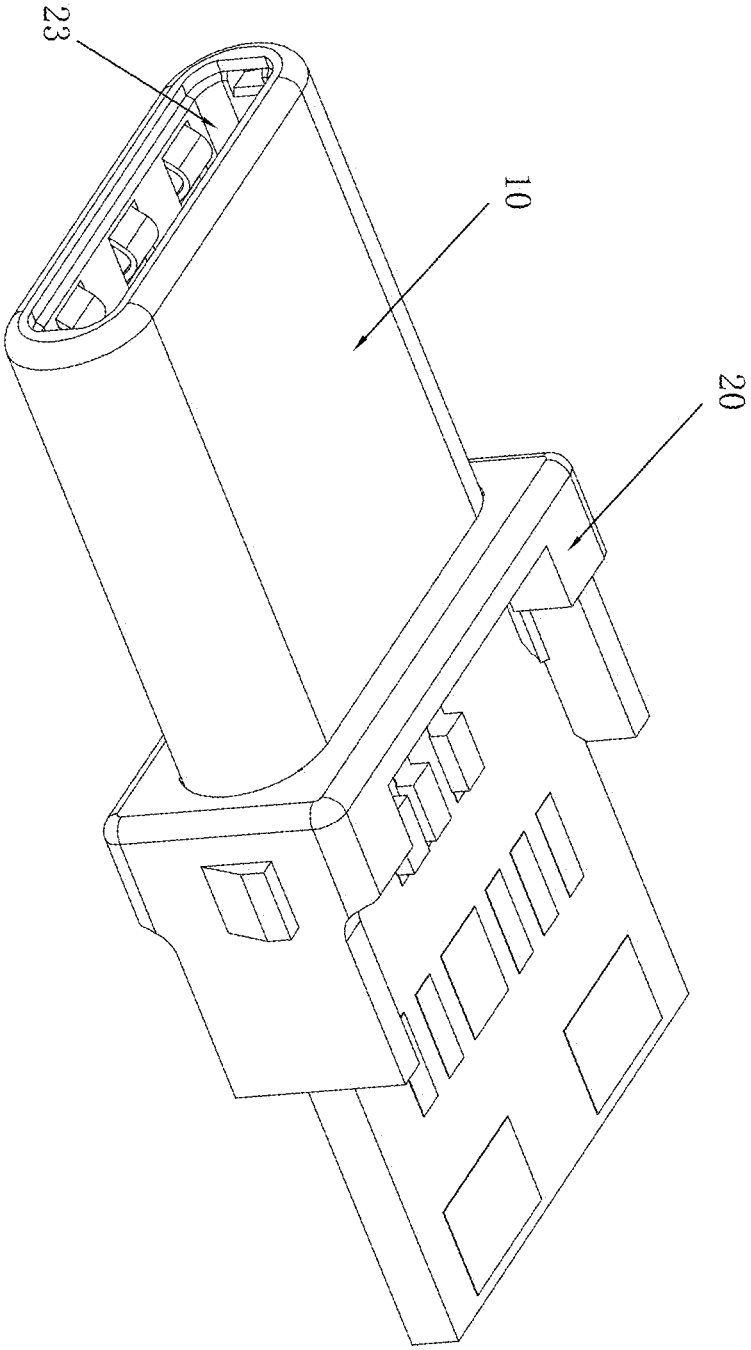
FIG. 1 is a stereoscopic assembly diagram of a connector plug according to an embodiment of the present invention.

Referring to FIG. 1 to FIG. 9, the specific structure of a preferred embodiment of the present invention is shown. The connector plug includes a shielding shell 10, an insulating base 20, a terminal module 30 and two baffles 40.

As shown in FIG. 2 to FIG. 5, the insulating base 20 includes a base 21 and a tongue plate 22 connected to a front end of the base 21, a front end face of the tongue plate 22 being backwards concavely provided with a slot 23 running through a rear end of the base 21. A plurality of through holes 221 running through the slot 23 are formed on the upper and lower surfaces of the tongue plate 22, isolating arms 222 being formed between adjacent through holes 221, the through holes 221 being disposed to correspond to the terminals one by one.

Figure 4:
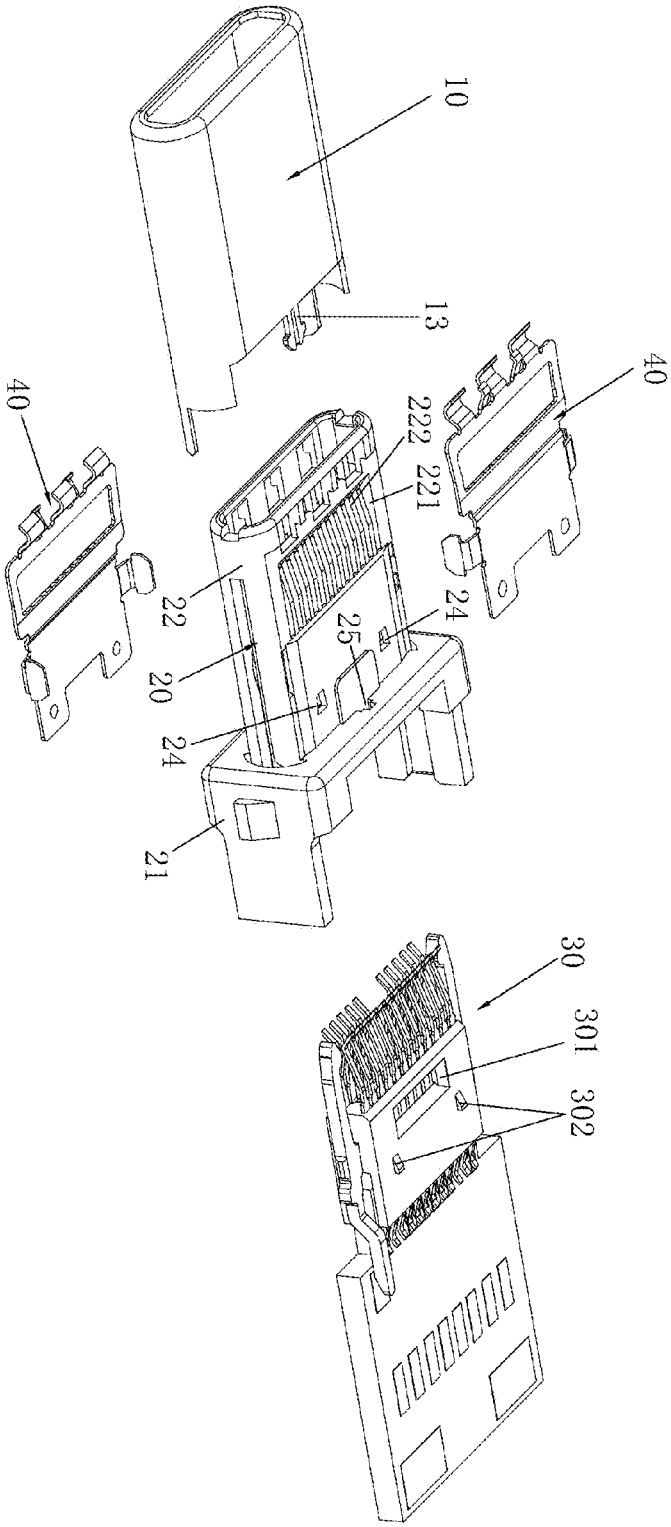
FIG. 4 is a third structural decomposition diagram of the connector plug according to an embodiment of the present invention.
Figure 5:
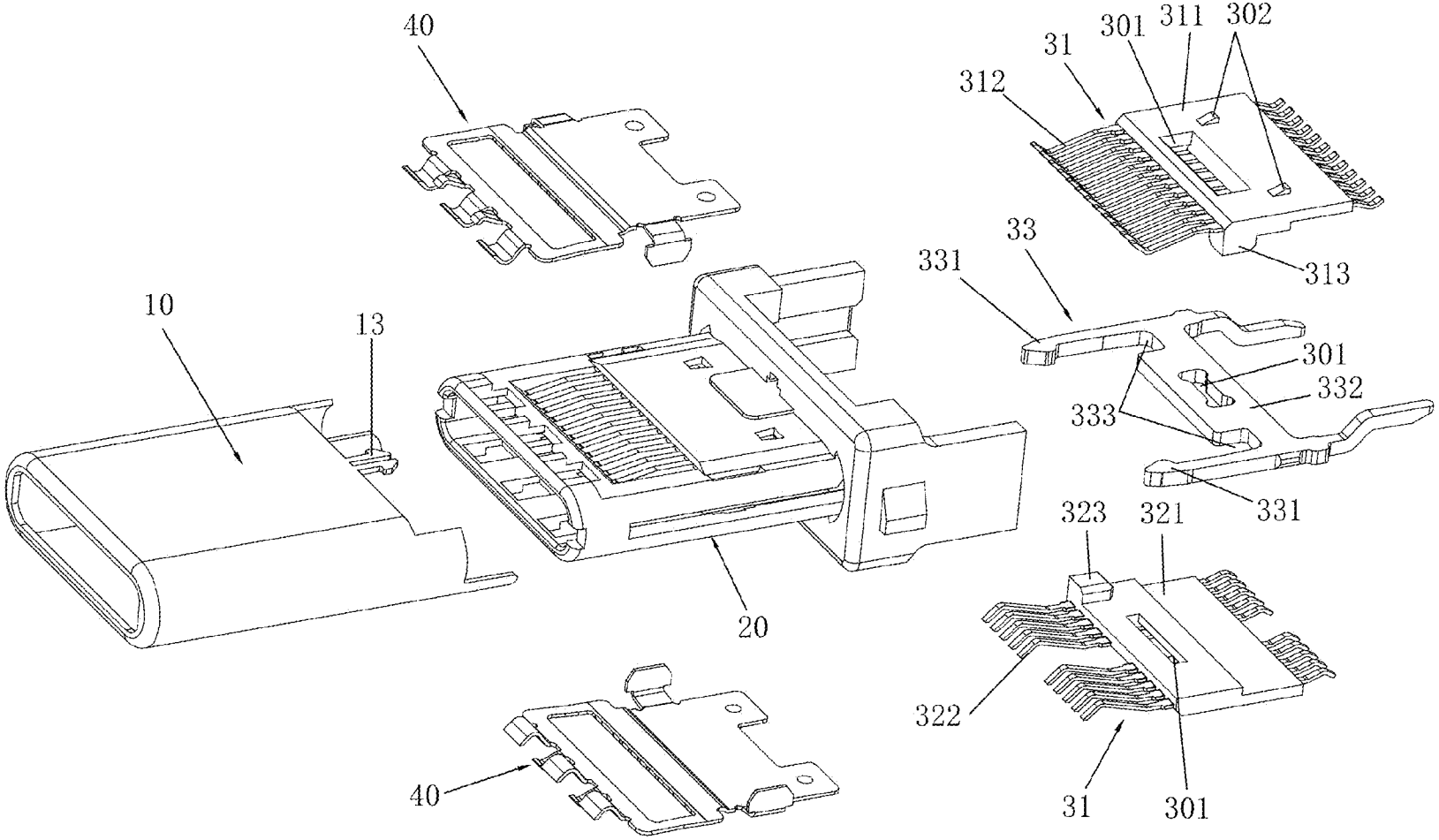
FIG. 5 is a fourth structural decomposition diagram of the connector plug according to an embodiment of the present invention.
Figure 6:
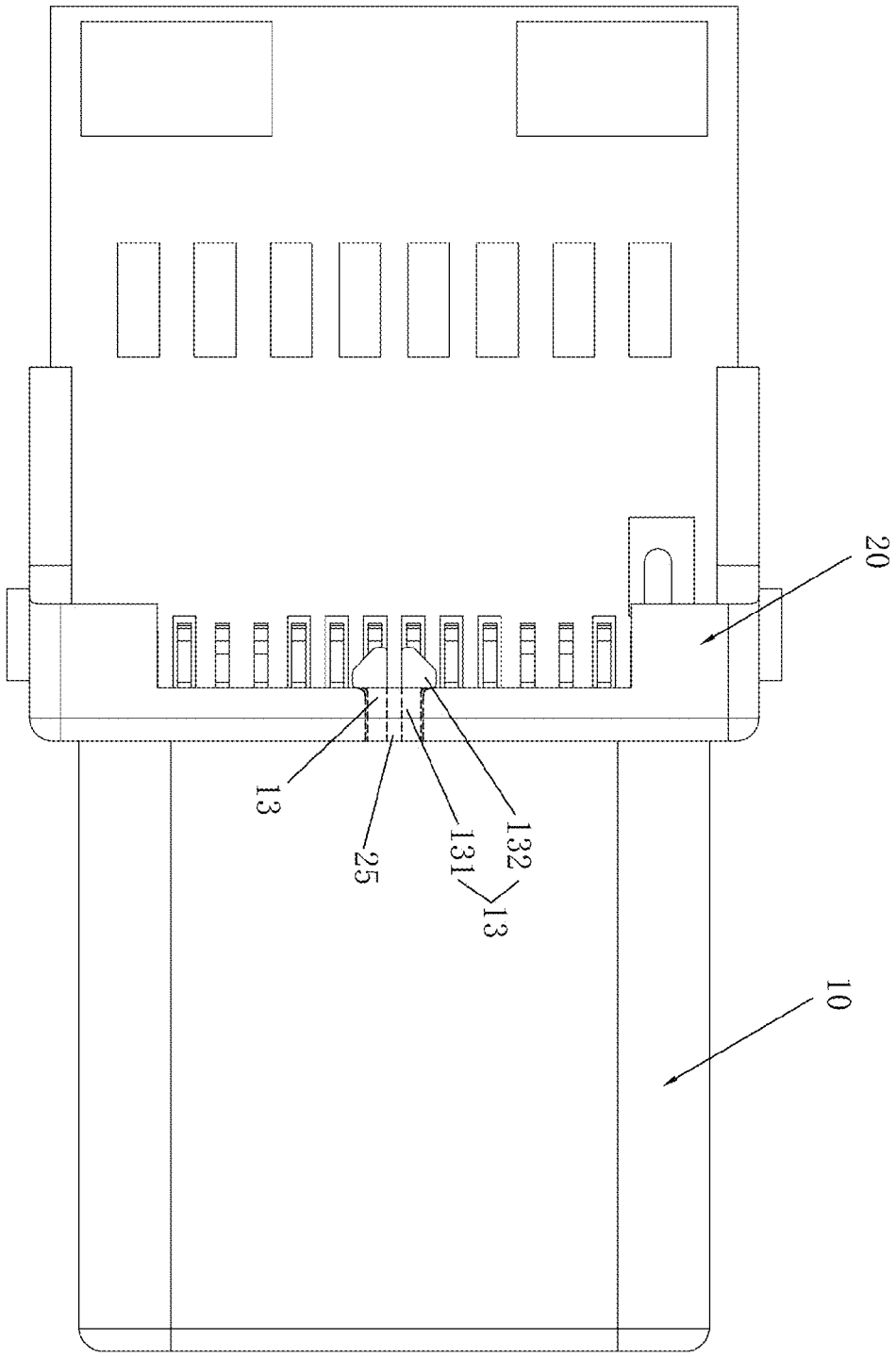
FIG. 6 is a top view of the connector plug according to an embodiment of the present invention.

As shown in FIG. 4 and FIG. 5, the terminal module 30 includes an upper terminal module 31, a lower terminal module 32 and a hook plate 33 sandwiched between the upper terminal module 31 and the lower terminal module 32. The upper terminal module 31 includes an upper terminal port 311 and an upper terminal group 312 embedded into the upper terminal port 311. The lower terminal module 32 includes a lower terminal port 321 and a lower terminal group 322 embedded into the lower terminal port 321. The hook plate 33 includes two hooks 331 and a spacer 332 connected between the two hooks 331, the spacer 332 isolating the upper terminal group 312 from the lower terminal group 322. The upper terminal port 311, the lower terminal port 321 and the spacer 332 are correspondingly provided with positioning holes 301 which are communicated to each other. The upper terminal module 31, the lower terminal module 32 and the hook plate 33 form an integral terminal module structure by secondary embedment molding through the positioning holes 301.

Figure 7:
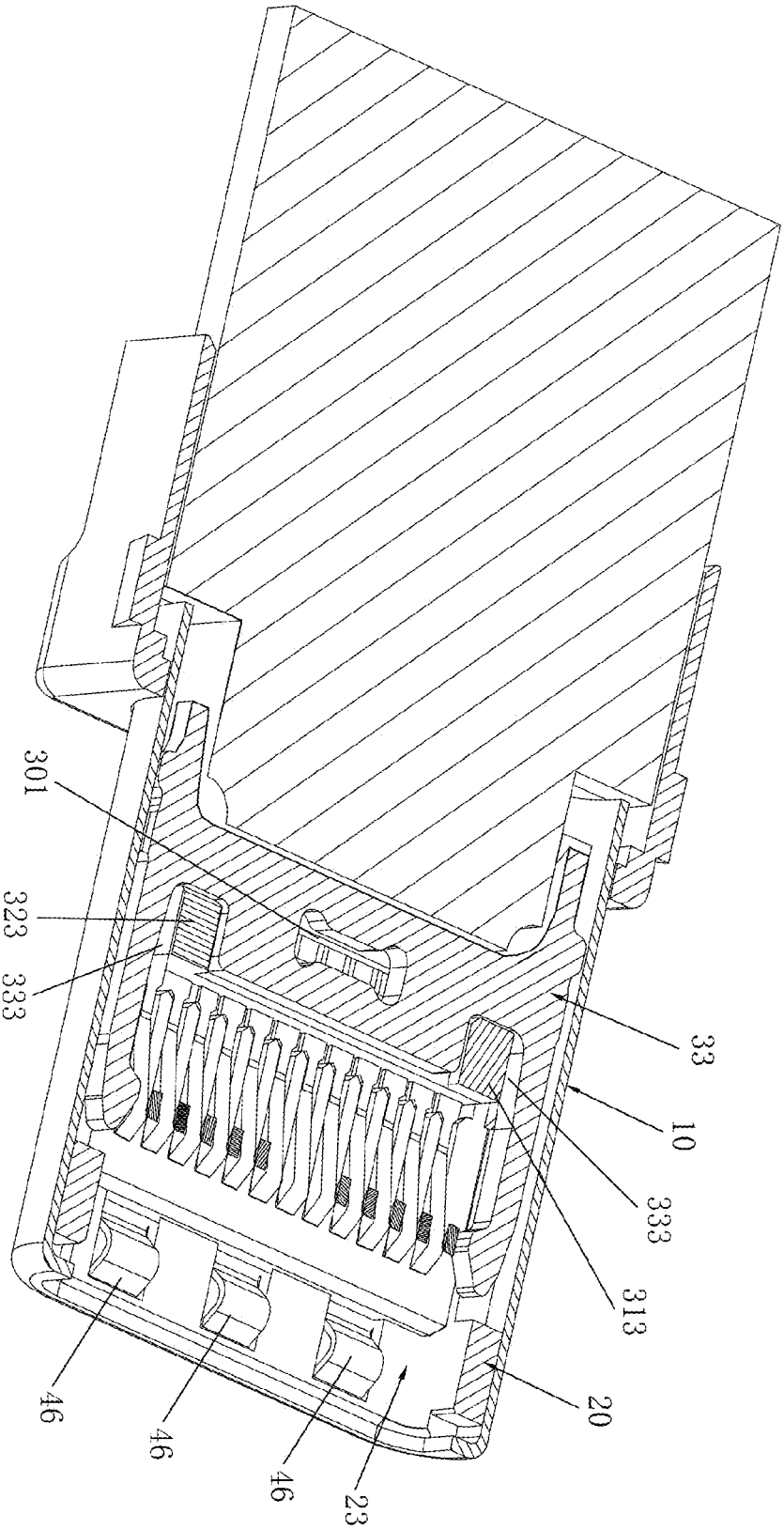
FIG. 7 is a first cross-sectional structure diagram of the connector plug according to an embodiment of the present invention.
Figure 8:
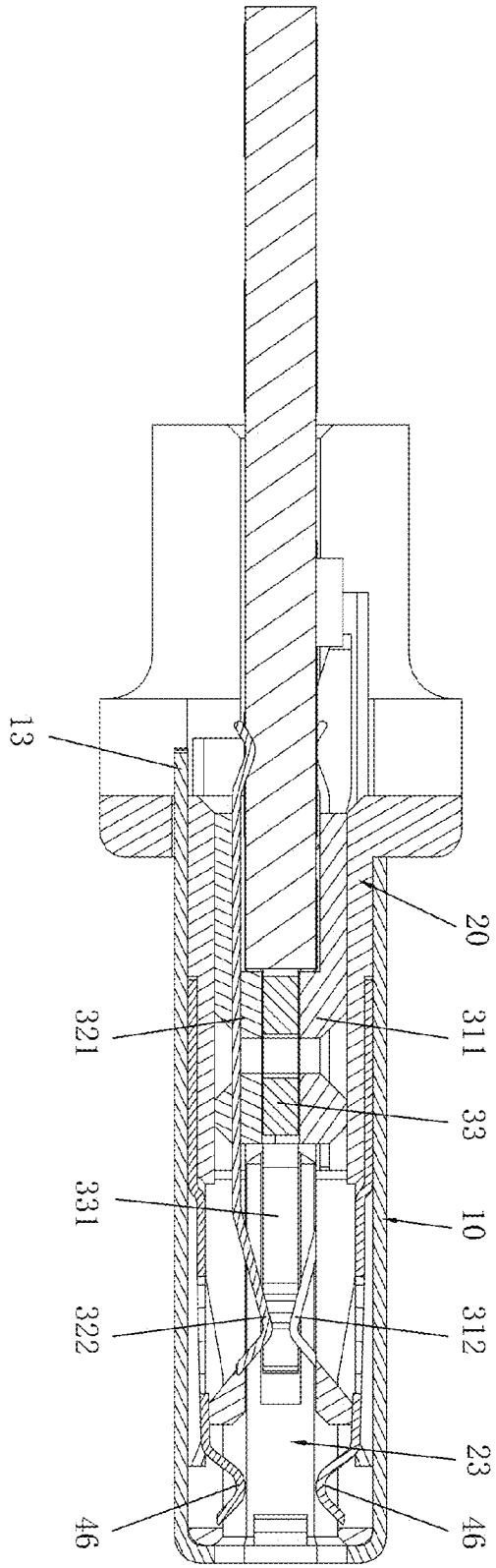
FIG. 8 is a second cross-sectional structure diagram of the connector plug according to an embodiment of the present invention.
Figure 9:
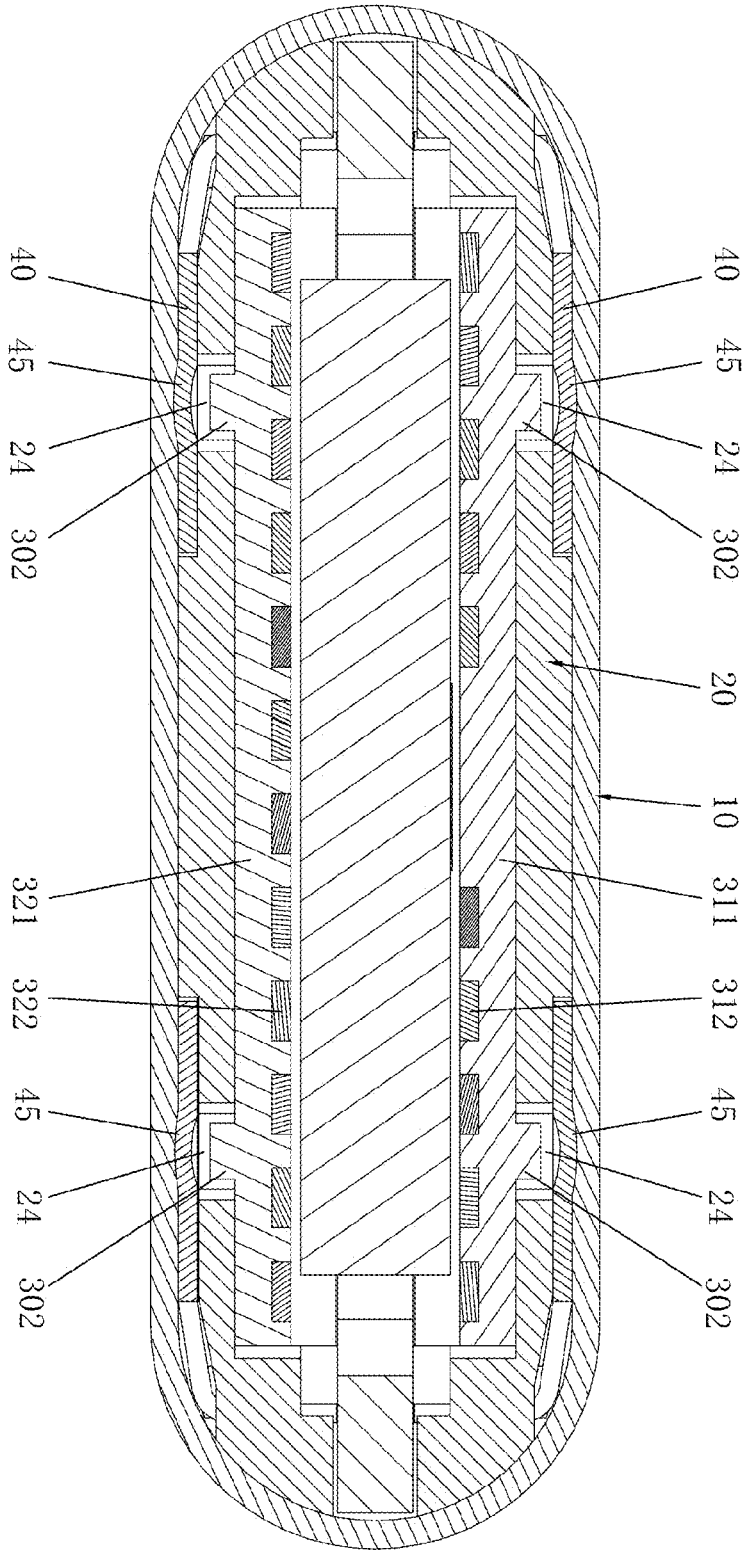
FIG. 9 is a third cross-sectional structure diagram of the connector plug according to an embodiment of the present invention.

As shown in FIG. 5, in this embodiment, a first limiting bulge 313 is downwards convexly provided on one side of a bottom end face of the upper terminal port 311, and a second limiting bulge 323 is upwards convexly provided on another side of a top end face of the lower terminal port 321. When the upper terminal module 31 and the lower terminal module 32 are superposed, the first limiting bulge 313 touches against the top end face of the lower terminal port 321, the second limiting bulge 323 touches against the bottom end face of the upper terminal port 311, and an accommodating chamber is sandwiched between the upper terminal port 311 and the lower terminal port 321. Notches 333 corresponding to the first limiting bulge 313 and the second limiting bulge 323 are formed between the spacer 332 and the hooks 331, respectively. The spacer 332 is located within the accommodating chamber, and the first limiting bulge 313 and the second limiting bulge 323 pass through the corresponding notches 333, respectively (as shown in FIG. 7). Positioning blocks 302 are convexly provided on the top end face of the upper terminal port 311 and the bottom end face of the lower terminal port 321, respectively. Correspondingly, positioning grooves 24 running through the slot 23 are formed on the upper and lower surfaces of the tongue plate 21, respectively. When the terminal module 30 is embedded into the slot 23 of the insulating base 20, the positioning blocks 302 are inserted into the corresponding positioning grooves 24, respectively.

As shown in FIG. 3 to FIG. 5 and FIG. 8, each of the baffles 40 includes a base plate portion 41 for covering each connecting portion of the corresponding upper and lower terminal groups, extended arms 42 separately integrally extending forwards from two sides of a front edge of the base plate portion 41 and a connecting arm 43 connected between the two extended arms 42. The base plate portion 41, the two extended arms 42 and the connecting arm 43 are enclosed to form an exposing cavity 44 which is disposed to correspond to each contact portion of the upper and lower terminal groups. A contact bulge 45 is convexly provided on the base plate portion 41 of each of the baffles 40, and the contact bulge 45 is in close contact against the inner wall face of the shielding shell 10 in the up-down direction. A first contact spring piece 46 for reinforcing a plug-in/out force and a second contact spring piece 47 for maintaining elastic contact connection to the shielding shell in an up-down direction are integrated at the front edge of the connecting arm 43, the direction of the contact elastic force of the first contact spring piece 46 being opposite to that of the second contact spring piece 47.

As shown in FIG. 2 to FIG. 6 and FIG. 9, the shielding shell 10 is of an integral chamber structure having a front opening 11 and a rear opening 12, which significantly different from the traditional splicing enclosure design, with a cross section of the shielding shell 10 in a direction vertical to an insertion direction being of a non-splicing closed-loop structure. A clasp 13 is provided at a rear end of the shielding shell 10, the clasp 13 including an embedding portion 131 integrally extending backwards from the rear end of the shielding shell 10 and a clasping portion 132 integrally disposed at the rear end of the embedding portion 131. Correspondingly, an embedding groove 25 is formed on the insulating base 20, and when the shielding shell 10 is assembled onto the insulating base 20, the clasp 113 is embedded into the embedding groove 25 and the clasping portion is reversely clasped onto the insulating base 20.

During manufacturing and assembling, the upper terminal group 312 is embedded into the upper terminal port 311 by primary embedment molding to form the upper terminal module 31, and the lower terminal group 322 is embedded into the lower terminal port 321 by primary embedment molding to form the lower terminal module 32 (as shown in FIG. 5).

Then, the upper terminal module 31, the hook plate 33 and the lower terminal module 32 are superposed in turn, and the upper terminal module 31, the lower terminal module 32 and the hook plate 33 form an integral terminal module 31 by secondary embedment molding through the positioning holes 301, so that the positioning of the upper terminal group 312 and the lower terminal group 322 is more accurate and firm. It is advantageous for the improvement of the contact performance of terminals and the stable signal transmission is ensured (as shown in FIG. 4).

Figure 3:
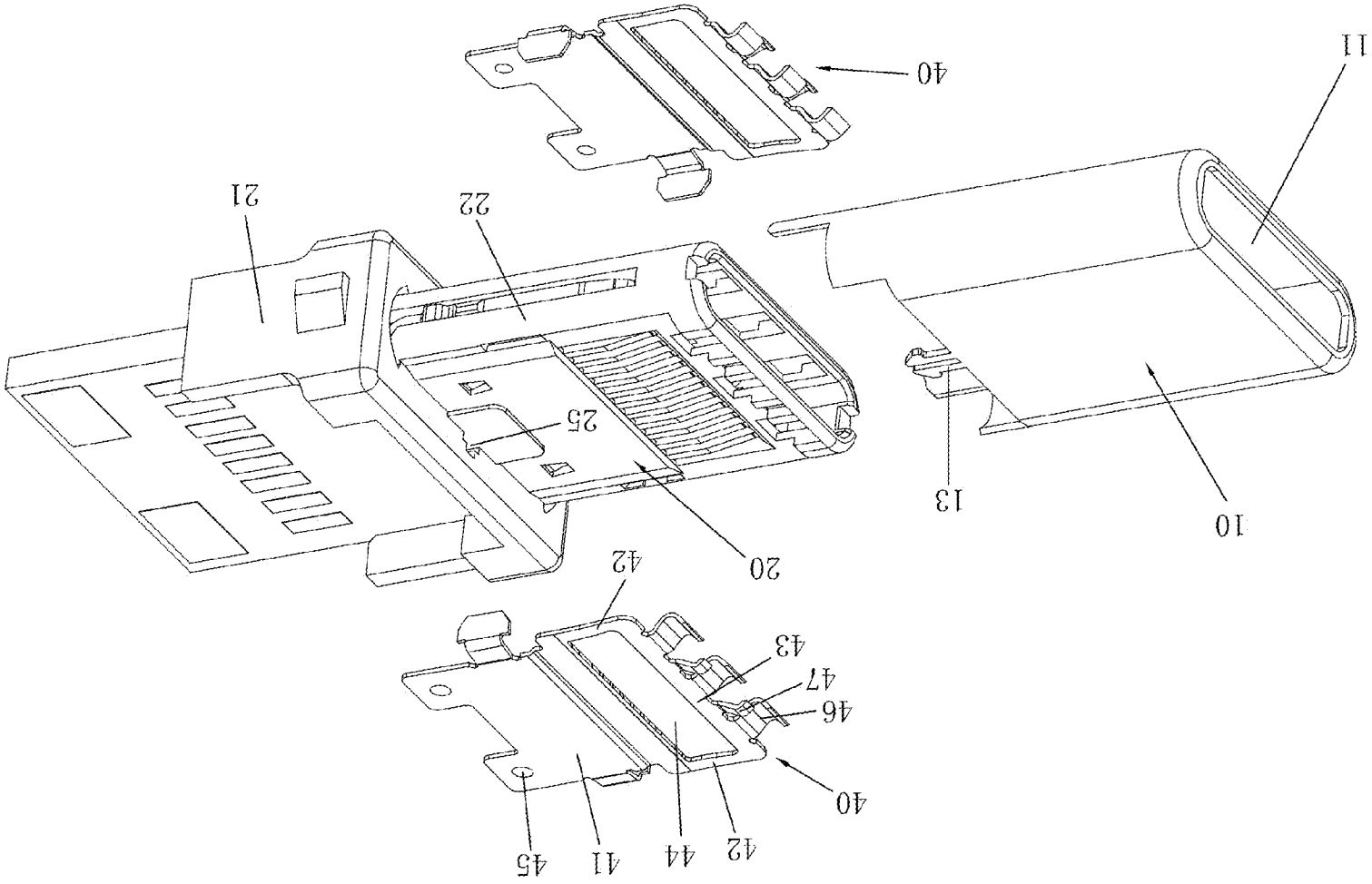
FIG. 3 is a second structural decomposition diagram of the connector plug according to an embodiment of the present invention.

Then, the integral terminal module 30 is then embedded into the slot 23 of the insulating base 20 from back to front, with the upper terminal 312 and the lower terminal group 322 being exposed from the upper and lower inner wall faces of the slot 23 and the positioning blocks 302 being inserted into the corresponding positioning grooves 24, respectively, so that firm assembling and positioning are realized, and the terminal module 30 is prevented from loosening and shifting within the insulating base 20 (as shown in FIG. 3).

Figure 2:
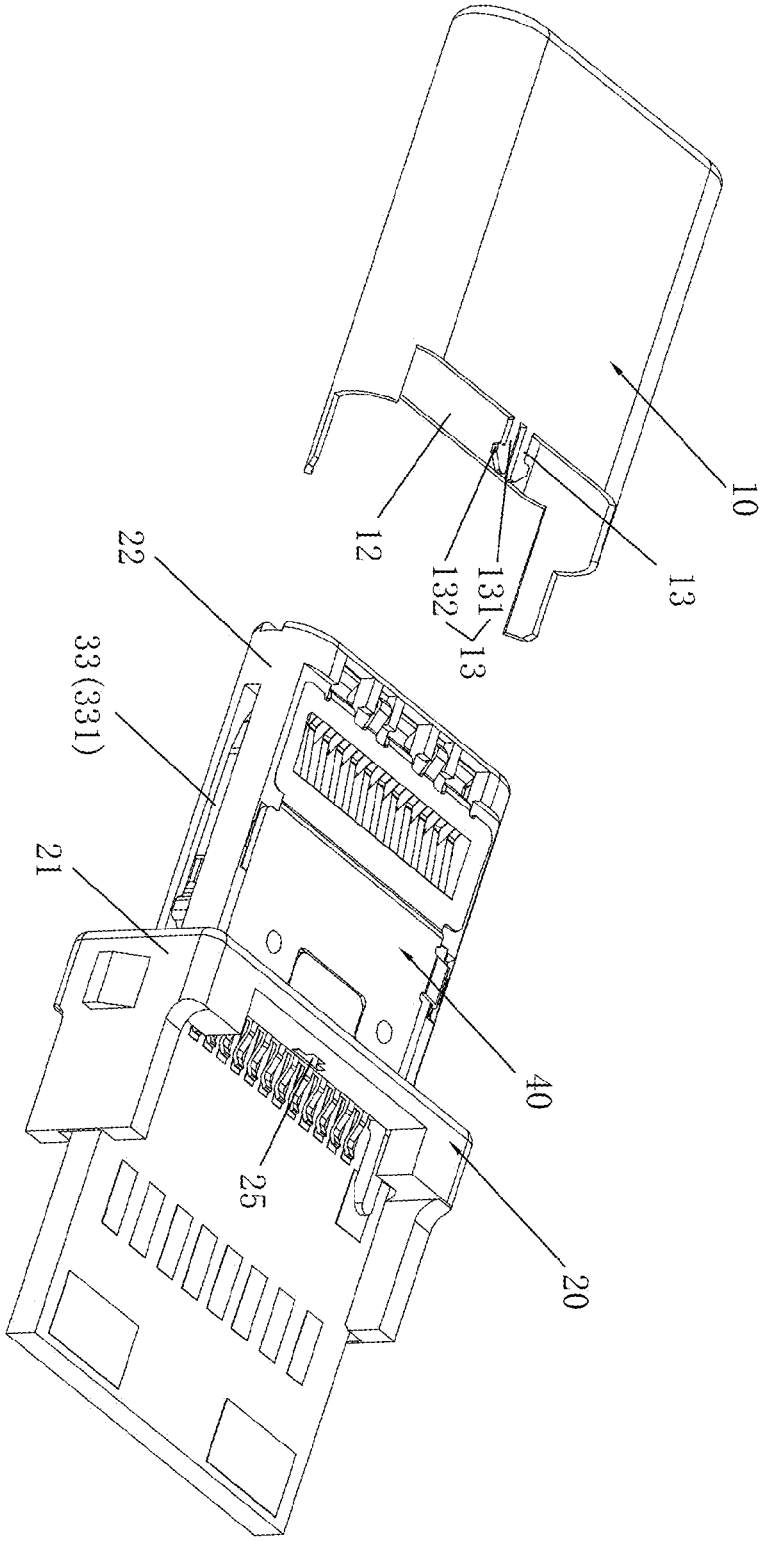
FIG. 2 is a first structural decomposition diagram of the connector plug according to an embodiment of the present invention.

Then, the two baffles 40 are disposed on the upper and lower surfaces of the tongue plate 22, respectively, and then positioned onto the tongue plate 22 by pins, with the first contact spring piece 46 thereof being exposed from the slot 23 through a straight groove on the tongue plate 22 (as shown in FIG. 2).

Finally, the shielding shell 10 is sheathed outside the tongue plate 22 from the rear opening of the shielding shell 10, with the clasp 13 being embedded into the embedding groove 24 and the clasping portion 132 being reversely clasped onto the insulating base 20, so that the shielding shell 10 and the insulating base 20 are assembled firmly to prevent the shielding shell 10 from loosening and it is advantageous for the shielding effect; and the second contact spring piece 47 is in upward elastic contact against the inner wall of the shielding shell 10*m* and the contact bulge 45 is in close contact against the inner wall of shielding shell 10 in the up-down direction, so that a good contact break-over between the baffles 40 and the shielding shell 10 and better shielding effect are realized and the stable signal transmission is further ensured (as shown in FIG. 1).

The foregoing description merely shows preferred embodiments of the present invention, and is not intended to limit the technical scope of the present invention. Therefore, any tiny modification, equivalent change and embellishment made to the foregoing embodiments in accordance with the technical essence of the present invention shall fall into the scope of the technical solutions of the present invention.

What is claimed is:

1. A connector plug, comprising a shielding shell, an insulating base, a terminal module and two baffles, wherein the insulating base comprises a base and a tongue plate connected to a front end of the base, a front end face of the tongue plate being backwards concavely provided with a slot running through a rear end of the base;

the terminal module comprises an upper terminal module, a lower terminal module and a hook plate sandwiched between the upper terminal module and the lower terminal module; the upper terminal module comprises an upper terminal port and an upper terminal group embedded into the upper terminal port; the lower terminal module comprises a lower terminal port and a lower terminal group embedded into the lower terminal port; the hook plate comprises two hooks and a spacer connected between the two hooks, the spacer isolating the upper terminal group from the lower terminal group; the upper terminal port, the lower terminal port and the spacer are correspondingly provided with positioning holes which are communicated to each other, and the upper terminal module, and the lower terminal module and the hook plate form an integral terminal module structure by secondary embedment molding through the positioning holes;

the terminal module is embedded into the slot of the insulating base, with the upper and lower terminal groups exposed from the upper and lower inner wall faces of the slot; a plurality of through holes running through the slot are formed on the upper and lower surfaces of the tongue plate, isolating arms being formed between adjacent through holes, the through holes being disposed to correspond to the terminals one by one; and the two baffles are disposed on upper and lower surfaces of the tongue plate, respectively, the shielding shell encloses the tongue plate and the two baffles, and the two baffles are connected to the shielding shell, respectively.

2. The connector plug according to claim 1, wherein a first limiting bulge is downwards convexly provided on one side of a bottom end face of the upper terminal port, and a second limiting bulge is upwards convexly provided on another side of a top end face of the lower terminal port; when the upper and lower terminal modules are superposed, the first limiting bulge touches against the top end face of the lower terminal port, the second limiting bulge touches against the bottom end face of the upper terminal port, and an accommodating chamber is sandwiched between the upper and lower terminal ports; notches corresponding to the first and second limiting bulges are formed between the spacer and the hooks, respectively; and the spacer is located within the accommodating chamber, and the first and second limiting bulges pass through the corresponding notches, respectively.

3. The connector plug according to claim 1, wherein positioning blocks are convexly provided on the top end face of the upper terminal port and the bottom end face of the lower terminal port, respectively; and correspondingly, positioning grooves running through the slot are formed on the upper and lower surfaces of the tongue plate, respectively; and, when the terminal module is embedded into the slot of the insulating base, the positioning blocks are inserted into the corresponding positioning grooves, respectively.

4. The connector plug according to claim 1, wherein each of the baffles comprises a base plate portion for covering each connecting portion of the corresponding upper and lower terminal groups, extended arms separately integrally extending forwards from two sides of a front edge of the base plate portion and a connecting arm connected between the two extended arms; the base plate portion, the two extended arms and the connecting arm are enclosed to form an exposing cavity which is disposed to correspond to each contact portion of the upper and lower terminal groups; and, a first contact spring piece for reinforcing a plug-in/out force and a second contact spring piece for maintaining elastic contact connection to the shielding shell in an up-down direction are integrated at the front edge of the connecting arm, the direction of the contact elastic force of the first contact spring piece being opposite to that of the second contact spring piece.

5. The connector plug according to claim 4, wherein a contact bulges is convexly provided on the base plate portion of each of the baffles, and the contact bulges is in close contact against the inner wall face of the shielding shell in the up-down direction.

6. The connector plug according to claim 1, wherein the shielding shell is of an integral chamber structure having a front opening and a rear opening, a cross section of the shielding shell in a direction vertical to an insertion direction being of a non-splicing closed-loop structure; a clasp is provided at a rear end of the shielding shell, the clasp comprising an embedding portion integrally extending backwards from the rear end of the shielding shell and a clasping portion integrally disposed at the rear end of the embedding portion; correspondingly, an embedding groove is formed on the insulating base, and when the shielding shell is assembled onto the insulating base, the clasp is embedded into the embedding groove and the clasping portion is reversely clasped onto the insulating base.

* * * * *